US008297616B2

(12) United States Patent
Tharayil

(10) Patent No.: US 8,297,616 B2
(45) Date of Patent: Oct. 30, 2012

(54) ADJUSTABLE IDLER ROLLERS FOR LATERAL REGISTRATION

(75) Inventor: Marina L. Tharayil, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/244,675

(22) Filed: Sep. 25, 2011

(65) Prior Publication Data

US 2012/0013067 A1 Jan. 19, 2012

Related U.S. Application Data

(62) Division of application No. 12/495,356, filed on Jun. 30, 2009, now Pat. No. 8,074,982.

(51) Int. Cl.
*B65H 7/02* (2006.01)

(52) U.S. Cl. ..... 271/228; 271/254

(58) Field of Classification Search ..... 271/228, 271/254

See application file for complete search history.

(56) References Cited

U.S. PATENT DOCUMENTS 5,094,442 A 3/1992 Kamprath et al.
5,697,609 A 12/1997 Williams et al.
6,053,494 A * 4/2000 Baskette et al. ..... 271/251
6,357,742 B1 3/2002 Ogasawara
6,533,268 B2 3/2003 Williams et al.
6,575,458 B2 6/2003 Williams et al.
6,634,521 B1 * 10/2003 Hwang ..... 221/228
6,866,260 B2 3/2005 Williams et al.
6,896,256 B2 5/2005 Hozumi
7,422,211 B2 9/2008 Dejong et al.
2005/0035528 A1 2/2005 Suga et al.
2009/0115124 A1 5/2009 Fioravanti et al.
2009/0152806 A1 6/2009 Buddendeck et al.

* cited by examiner

*Primary Examiner* — Gerald McClain
(74) *Attorney, Agent, or Firm* — Hoffman & Baron, LLP

(57) ABSTRACT

An assembly includes two nip assemblies spaced apart along a first axis. Each nip assembly includes a driven wheel and an idler roller. The driven wheel rotatably supported about the first axis. The idler cooperates with the driven wheel to engage a sheet. The idler rotatably supported about a second axis. The second axis being selectively moveable relative to the first axis. The selective movement between a first and second orientation occurs while the sheet is moved along the transport path. In the first orientation the second axis extends parallel to the first axis. In the second orientation the second axis extends at an oblique angle to the first axis. The selective movement pivots about a third axis extending through a centerline common to both the driven wheel and the idler. The selective movement of one of the two nip assemblies being independent from the selective movement of the other.

14 Claims, 5 Drawing Sheets

ADJUSTABLE IDLER ROLLERS FOR LATERAL REGISTRATION

CROSS-REFERENCE TO RELATED APPLICATIONS

This application is a divisional of U.S. patent application Ser. No. 12/495,356 filed on Jun. 30, 2009, the disclosure of which is incorporated herein in its entirety by reference.

TECHNICAL FIELD

The presently disclosed technologies are directed to an apparatus for and a method of registering the lateral position of a sheet in a media handling assembly, such as a printing system, using adjustable idler rollers.

BACKGROUND

In media handling assemblies, particularly in printing systems, accurate and reliable registration of the substrate media as it is transferred in a process direction is desirable. In particular, accurate registration of the substrate media, such as a sheet of paper, as it is delivered at a target time to an image transfer zone will improve the overall printing process. The substrate media is generally conveyed within the system in a process direction. However, often the substrate media can shift in a cross-process direction that is lateral to the process direction or even acquire an angular orientation, referred herein as "skew," such that its opposed linear edges are no longer parallel to the process direction. Thus, there are three degrees of freedom in which the substrate media can move, which need to be controlled in order to achieve accurate delivery thereof. A slight lateral misalignment, skew or error in the arrival time of the substrate media through a critical processing phase can lead to errors, such as image and/or color registration errors. Also, as the substrate media is transferred between sections of the media handling assembly, the amount of positioning error can increase or accumulate.

Contemporary media handling systems attempt to achieve position registration of sheets by separately varying the speeds of spaced apart drive wheels to correct for skew and/or lateral mispositioning of the sheet. Such systems that separately vary the drive wheel speeds are commonly referred to as differential drive systems. The drive wheels are used with cooperating idler rollers for engaging the substrate media there between. The differential drive wheels with the idler rollers are together referred to as differential nip assemblies.

Examples of typical sheet registration and deskewing systems are disclosed in U.S. Pat. Nos. 5,094,442, 6,533,268, 6,575,458 and 7,422,211, commonly assigned to the assignee of record herein, namely Xerox Corporation, the disclosures of which are each incorporated herein by reference. While these systems particularly relate to printing systems, similar paper handling techniques apply to other media handling assemblies. Such contemporary systems transport a sheet and deliver it at a target time to a target location, based on measurements from the sheet sensors. The target location can be a particular point in a transfer zone, a hand-off point to a downstream nip assembly or any other target location within the media handling assembly. Typically, based on sheet sensor measurements, a controller can adjust the sheet velocity to steer the sheet to a target location at a desired time. The controller uses the differential drive system to correct primarily for skewed positional errors detected for the sheet. Temporarily driving two motors at slightly different rotational speeds induces a rotational sheet motion that is used to eliminate/correct for detected skew and/or process timing errors.

The resultant dynamics are nonlinear and make closed-loop feedback control complex and difficult to execute.

Other contemporary systems use alternative cross-process correction techniques, such as nip assemblies that translate laterally in order to shift the sheet while engaged within the nips. However, laterally translating nip assemblies include driven wheels mounted on a moveable carriage assembly. Driven wheels inherently include motors, gears and/or belts associated therewith, thus such assemblies are complex, costly, prone to mechanical failure and difficult to repair. Also, having to reset the mechanical carriage between sheets limits the speeds and inter-copy gaps at which the system can function.

Another alternative system uses nip assemblies with fixed angled driven wheels that drive the sheets into a straight edge fence or rail, thereby correcting both cross-process and skew errors simultaneously. However, such systems are limited in the size and type of substrate media being handled and are prone to marking, buckling or damaging the substrate media.

Accordingly, it would be desirable to provide an apparatus for and a method of registering the lateral position of a sheet in a media handling assembly, which overcomes the shortcoming of the prior art.

SUMMARY

According to aspects described herein, there is disclosed an apparatus for laterally registering a sheet moved in a process direction along a transport path in a media handling assembly. A lateral direction extends perpendicular to the process direction. The assembly including at least two nip assemblies spaced apart from one another along a first axis extending in the lateral direction. Each nip assembly including a driven wheel and an idler roller. The driven wheel rotatably supported about the first axis and the idler roller cooperating with the driven wheel to engage the sheet there between. The idler roller rotatably supported about a second axis, with the second axis being selectively moveable between a first and second orientation while the sheet is moved along the transport path. In the first orientation, the second axis extending parallel to the first axis, and in the second orientation the second axis extending at an oblique angle to the first axis. The selective movement of the second axis pivoting about a third axis substantially extending through a centerline common to both the driven wheel and the idler roller of each nip assembly.

Additionally, the selective movement of at least one of the at least two nip assemblies can be independent from the selective movement of another of the at least two nip assemblies. The selective movement of the at least two nip assemblies can occur in unison. In the second orientation the oblique angle can be limited to not exceed approximately 10 degrees. Also, at least one of the at least two nip assemblies can be disposed in the first orientation while another of at least two nip assemblies can be disposed in the second orientation. Further, a first surface material of the drive wheel can be more compliant than a second surface material of the idler roll.

Also, the apparatus can include a linkage mechanism coupling the idler rollers of the at least two nip assemblies for the selective movement in unison. Additionally, the apparatus can include a controller for actuating the idler roller to move between the first orientation and the second orientation. Further, the apparatus can include at least one sensor for detecting a lateral position of the sheet. Further still, the apparatus can include a differential drive system operatively connected to the driven wheels of at least two nip assemblies. The differential drive system can impart different rotational velocities to each driven wheel.

According to other aspects described herein, there is a method of registering a lateral position of a sheet moved substantially in a process direction along a transport path in a media handling assembly. A lateral direction extending perpendicular to the process direction. The method including providing at least two nip assemblies, where each nip assembly includes a driven wheel and an idler roller. The driven wheel being rotatably supported about a first axis extending in the lateral direction. The idler roller cooperating with the driven wheel to engage the sheet there between. The idler roller being rotatably supported about a second axis. Also, the method including pivoting the idler roller about a third axis substantially extending through a centerline common to both the driven wheel and the idler roller. Whereby the second axis of rotation pivots between a first and second orientation. In one of the first and second orientations the second axis extends parallel to the first axis and in the other of the first and second orientations the second axis extends oblique to the first axis.

Additionally, the idler roller pivoting of at least one of the at least two nip assemblies can be independent from the idler roller pivoting of another of the at least two nip assemblies. Also, the method can further include measuring a lateral position of the sheet during and/or after the idler roller pivoting for continuous pivotal adjustment of the idler roller. The at least two nip assemblies can be spaced apart from one another along the first axis. The idler roller pivoting of the at least two nip assemblies can occur in unison. Further, an actuating linkage mechanism can be provided for pivoting the at least two nip assemblies in unison. Further still, each idler roller of the at least two nip assemblies can pivot a different degree of rotation. The method can further include driving a first driven wheel of the at least two nip assemblies at a different rotational speed than a second driven wheel of the at least two nip assemblies for imparting a rotational skew velocity to the sheet.

These and other aspects, objectives, features, and advantages of the disclosed technologies will become apparent from the following detailed description of illustrative embodiments thereof, which is to be read in connection with the accompanying drawings.

DETAILED DESCRIPTION

Figure 1:
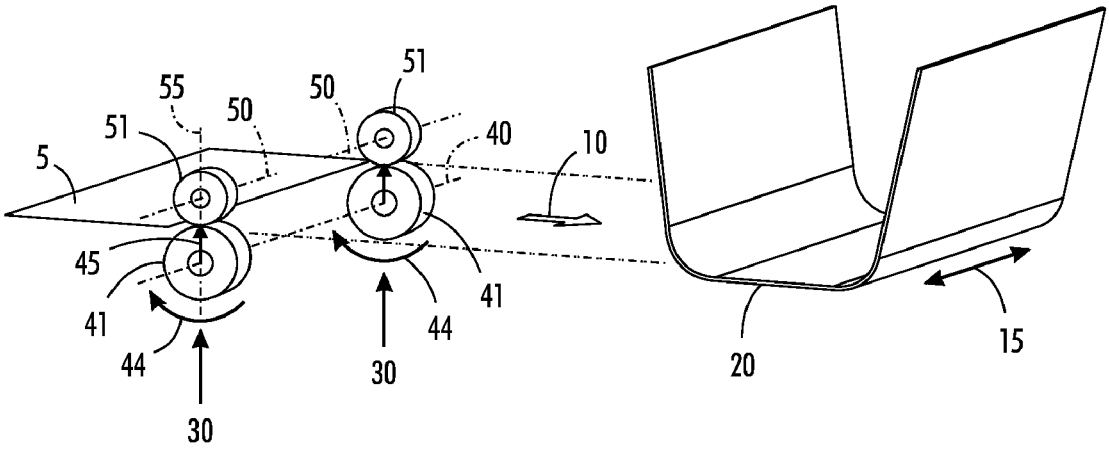
FIG. 1 is a partially schematic isometric view of two nip assemblies for laterally registering a sheet in a media handling assembly in accordance with an aspect of the disclosed technologies.

Describing now in further detail these exemplary embodiments with reference to the Figures, as described above the accurate sheet registration system and method are typically used in a select location or locations of the paper path or paths of various conventional media handling assemblies. Thus, only a portion of an exemplary media handling assembly path is illustrated herein.

As used herein, a "printer," "printing assembly" or "printing system" refers to one or more devices used to generate "printouts" or a print outputting function, which refers to the reproduction of information on "substrate media" for any purpose. A "printer," "printing assembly" or "printing system" as used herein encompasses any apparatus, such as a digital copier, bookmaking machine, facsimile machine, multi-function machine, etc. which performs a print outputting function.

A printer, printing assembly or printing system can use an "electrostatographic process" to generate printouts, which refers to forming and using electrostatic charged patterns to record and reproduce information, a "xerographic process", which refers to the use of a resinous powder on an electrically charged plate record and reproduce information, or other suitable processes for generating printouts, such as an ink jet process, a liquid ink process, a solid ink process, and the like. Also, such a printing system can print and/or handle either monochrome or color image data.

As used herein, "substrate media" refers to, for example, paper, transparencies, parchment, film, fabric, plastic, photo-finishing papers or other coated or non-coated substrates on which information can be reproduced, preferably in the form of a sheet or web. While specific reference herein is made to a sheet or paper, it should be understood that any substrate media in the form of a sheet amounts to a reasonable equivalent thereto. Also, the "leading edge" of a substrate media refers to an edge of the sheet that is furthest downstream in the process direction. The "lateral edge" or "lateral edges" of the substrate media refers to one or more of the opposed side edges of the sheet, extending substantially in the process direction.

As used herein, a "media handling assembly" refers to one or more devices used for handling and/or transporting substrate media, including feeding, printing, finishing, registration and transport systems.

As used herein, "sensor" refers to a device that responds to a physical stimulus and transmits a resulting impulse for the measurement and/or operation of controls. Such sensors include those that use pressure, light, motion, heat, sound and magnetism. Also, each of such sensors as refers to herein can include one or more point sensors and/or array sensors for detecting and/or measuring characteristics of a substrate media, such as speed, orientation, process or cross-process position and even the size of the substrate media. Thus, reference herein to a "sensor" can include more than one sensor.

As used herein, "skew" refers to a physical orientation of a substrate media relative to a process direction. In particular, skew refers to a misalignment, slant or oblique orientation of an edge of the substrate media relative to a process direction.

As used herein, the terms "process" and "process direction" refer to a process of moving, transporting and/or handling a substrate media. The process direction is a flow path (also described as a transport path) the substrate media moves in during the process. A "cross-process direction" is perpendicular to the process direction and generally extends parallel to the web of the substrate media.

FIG. 1 depicts a partially schematic isometric view of an apparatus for laterally registering a sheet handled in a printing system. It should be noted that the partially schematic drawings herein are not to scale. In FIG. 1, the process direction 10 corresponds to the primary direction of flow of the sheet 5, indicated by a large arrow, heading from an upstream location toward a downstream location. The cross-process or lateral direction 15 extends perpendicular to the process direction. In this way, the sheet 5 generally travels across a pair of nip assemblies 30 toward a transfer area 20. It should be understood that transfer area 20, could include an image transfer system, such as the belt shown, an image transfer drum or other media handling assembly not limited to image transfer systems. Each nip assembly 30 includes a driven wheel 41 and idler roller 51 that cooperate to engage the sheet 5 there between, thereby moving the sheet 5 in the overall assembly. The driven wheel 41 is rotatably driven by a motor assembly coupled thereto by gears, belts, pulleys or other known methods. The idler roller 51 is rotatably mounted to freely rotate as a sheet 5 engages it and passes through the nip 30. In order to grab and/or engage the sheet 5, one or both of the driven wheel 41 and idler roller 51 are biased toward one another, such as the biasing force 45 shown.

Figure 2:
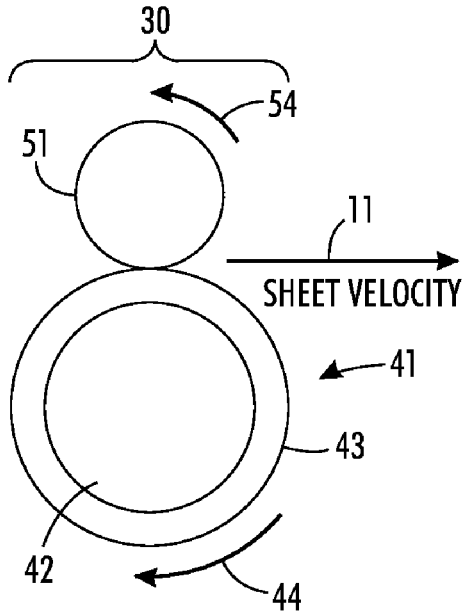
FIG. 2 is a side view of a basic nip assembly.

FIG. 2 shows a side view of a basic nip assembly 30, which includes a driven wheel 41 that cooperates with an idler roller 51 to induce sheet velocity 11. The driven wheel 41 includes an outer surface material 43 that is generally softer or more compliant than the inner drive roller 42 or the idler roller 51. For example, the outer surface material 43 can be silicone rubber or a similarly compliant material. In contrast, the idler roller 51 can be formed of a less compliant surface, such as a hard metal. As in contemporary systems, the driven wheel 41, and more particularly the drive roller 42 is coupled to a drive mechanism that is regulated by a programmable and/or automated controller (not shown). The diameter or width of the individual drive or idler rollers can be varied as desired and/or as necessary for the particular application. It is generally understood in the media handling arts that the sheet velocity 11 can differ from the drive roller velocity 44 due to the compliance of the elastomer of the outer surface material 43. In contrast, the less compliant idler roller velocity 54 is driven by frictional forces between the sheet and the hard roller 51 surface. Thus, the idler roller velocity 54 for a hard surface idler roller 51 generally matches or is generally closer to the sheet velocity 11, than the drive roller velocity 44. Alternatively, the idler roller 51 could be coated or provided with a soft or compliant outer surface. In one such alternative arrangement, the compliant idler roller 51 can still be less compliant than the driven wheel. In a further alternative embodiment, the more compliant outer surface material is only used on the idler roller 51, with a less compliant or non-compliant (hard) driven wheel 41.

Figure 3:
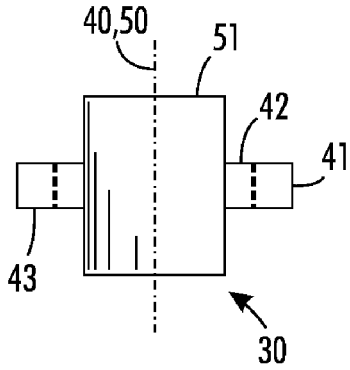
FIG. 3 is a top view of the nip assembly of FIG. 2.
Figure 4:
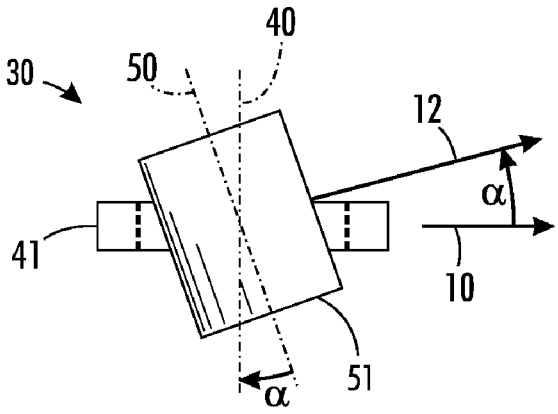
FIG. 4 is a top view of the nip assembly of FIG. 2, with an idler roller skewed relative to the driven wheel in accordance with an aspect of the disclosed technologies.

FIGS. 3 and 4 depict a top view of the basic nip assembly 30. FIG. 3 shows the idler roller 51 in different orientations than that shown in FIG. 4, relative to the driven wheel 41. It should be noted that the widths of the driven wheel 41 and idler roller 51 are shown to be drastically different for illustrative purposes. The actual widths are a matter of design choice. In FIG. 3, the driven wheel 41 includes a rotational axis 40 that is parallel to the rotational axis 50 of the idler roller 51. Due to the top view orientation of FIG. 3, the two rotational axis 40, 50 appear as a single axis, however their offset relationship is more clearly shown in FIG. 1. In particular, FIG. 1 shows the rotational axis 40 of both drive wheels 41 being offset (vertically in the configuration shown) from both idler roller rotational axis 50, although they remain parallel. In FIG. 4, the idler roller 51 has been pivoted about an axis extending substantially through a centerline common to both the driven wheel 41 and the idler roller 51, in accordance with an aspect of the disclosed technologies. In the top view orientation shown in FIG. 4, the pivoting axis extends directly into and out from the page. The pivoting axis is generally perpendicular to both the process direction 10 and the lateral direction 15. As shown in FIG. 1, the pivoting axis 55 extends vertically, which is perpendicular to the horizontal sheet path shown. A non-horizontal sheet path would mean the axis 55 extends in a non-vertical direction, but still perpendicular to both the process direction and the lateral direction. With regard to FIG. 4, the pivoted idler roller 51 creates an angle $\alpha$ between the driven wheel rotational axis 40 and the idler roller rotational axis 50. Thus, when angle $\alpha$ is not zero, the idler axis 50 is said to be at an oblique angle to the driven wheel axis 40. The same angle $\alpha$ is thereby created between the process direction 10 and idler velocity vector 12.

By changing the angle $\alpha$ between the driven wheel rotational axis 40 and the idler roller rotational axis 50, lateral sheet correction can be achieved. Also, such induced lateral sheet motion is decoupling motion from the process and/or skew direction motions generated by traditional systems. In accordance with an aspect of the disclosed technologies, the more compliant driven wheel 41 imparts a process direction movement, while the less compliant angled idler rollers 51 translate that process direction movement into a lateral component imparted by velocity vector 12. The angled idler rollers 51 thus create "nip and paper dynamics" that can be used for lateral registration correction. Also, by pivoting the idler roller axis 50 relative to the driven wheel axis 40, on a sheet-by-sheet basis, lateral registration can be maintained for each sheet even though lateral sheet drift can vary among sheets. A similar but somewhat different nip and paper dynamics can be achieved by switching the more compliant sheet engagement surface to the idler rollers. As long as the axis of rotation of the driven wheel and/or the idler roller can be changed relative to one another, so that they no longer rotate on parallel axis, lateral sheet movement can be induced.

As the angle $\alpha$ is increased from zero, the rate of induced sheet lateral movement should also increase. However, when a hard non-compliant roller or wheel is used, the rate of induced sheet lateral movement will reach a peak or limit once the angle $\alpha$ gets too large. Thus, depending on the materials used for the nip sheet engagement surfaces, the angle $\alpha$ can have a limit value after which no additional increase in the rate of lateral movement for the sheet can be induced. This is mainly due to sheet slippage with the low coefficient of friction non-compliant nip engagement surfaces. Additionally, the composition and texture of the sheet, as well as the sheet velocity can also effect such a limit value for the angle $\alpha$. Accordingly, it can be advantageous to limit how much pivot about the pivoting axis 55 is allowed to be actuated between the driven wheel 41 and the idler roller 51. Thus, a predesignated limit value can be assigned or set for a maximum oblique angle $\alpha$.

Figure 5:
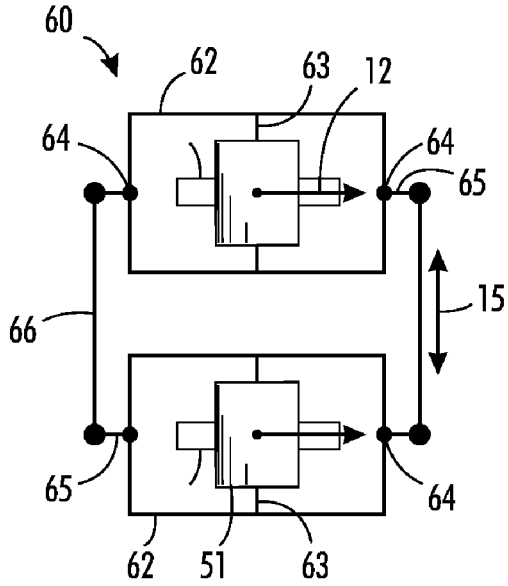
FIG. 5 is a plan view of an adjustable idler assembly in accordance with an aspect of the disclosed technologies.
Figure 6:
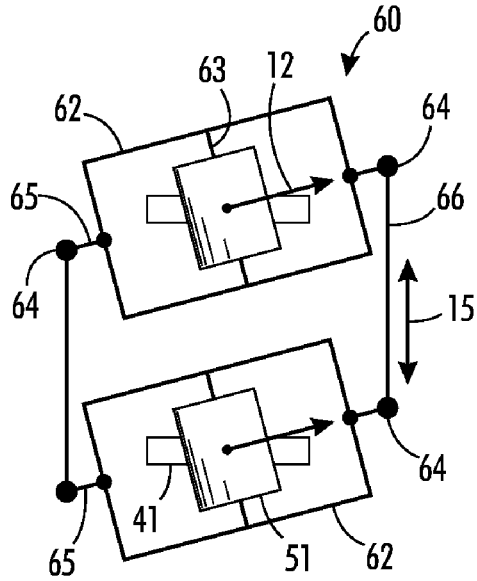
FIG. 6 is a plan view of the assembly of FIG. 5, with the idler rollers skewed relative to the driven wheels in accordance with an aspect of the disclosed technologies.

FIGS. 5 and 6 depict a linkage mechanism 60 for adjusting idler angles of both nip assemblies in unison. The linkage mechanism 60 includes individual idler frames 62 for each idler roller 51. The idler frames 62 are shown as a rectangular rigid structure with a central shaft 63 rotationally supporting the idler roller 51. Each of these central shafts 63 coincide with the idler roller axis 50, discussed with regard to FIGS. 1, 3 and 4. Also, opposed sides of the idler frame 62 include a pivotal coupling joint 64 for linking the two idler frames 62 in order for them to move in unison. The use of further linkage bars 65, 66 and coupling joints 64 link the two frames 62.

Thus, opposed sides of the frames 62 include process direction linkage bars 65. Each of the process direction linkage bars 65 is pivotally connected through a coupling joint 64, on one side by the frame 62 and on its opposite side by a lateral linkage bar 66. The lateral linkage bars 66 are pivotally coupled through a coupling joint 64 at opposed ends by process direction linkage bars 65 that connect to separate frames 62. By providing a mechanism (not shown) for inducing opposite lateral 15 movement of the two linkage bars 66, the frames 62 will pivot. Thus, as shown in FIG. 6, by shifting the right side (downstream side) lateral linkage bar 66 upwardly and the left side (upstream side) lateral linkage bar 66 downwardly, both frames 62 pivot. Accordingly, once the frames 62 are pivoted relative to the driven wheels 41, the idler velocity vector 12 is no longer parallel with the process direction and will thus induce lateral sheet movement. It should be understood that although a rectangular and/or linear linkage mechanism structure is shown, alternative structures can be used to achieve the same or similar unified movement.

Figure 7:
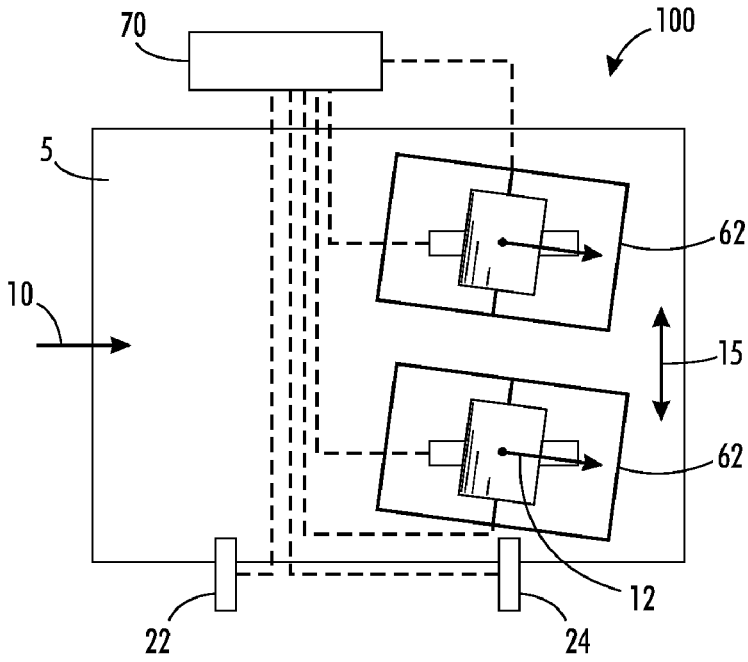
FIG. 7 is a plan view of the assembly of FIG. 6 in conjunction with a system controller, sensors and a handled sheet in accordance with an aspect of the disclosed technologies.

FIG. 7 depicts an alternative embodiment registration system 100 where the individual idler frames 62 are not coupled to one another, but rather are separately actuated by a controller 70. FIG. 7 also shows a sheet 5 conveyed in the process direction 10 through two nip assemblies used in conjunction with edge sensors 22, 24, all coupled to a controller 70. Edge sensors 22, 24 can be used to detect the lateral and process position, as well as orientation, of the sheet 5 relative to the nip assemblies. While two sensors 22, 24 are shown, it should be understood that fewer or greater numbers of sensors could be used, depending on the type of sensor, the desired accuracy of measurement and redundancy needed or preferred. For example, a pressure or optical sensor could be used to detect when the lateral edge of the sheet passes over each individual sensor. Additionally, the sensors can be positioned further upstream or closer to the nip assemblies, as desired. It should be appreciated that any sheet sensing system can be used to detect the position and/or other characteristics of the substrate media in accordance with the disclosed technologies. Once the actual lateral sheet position is measured by the sensors 22, 24, the controller 70 can actuate one or both of the idler frames 62 in order to correct the lateral sheet position. In the previous embodiment where both idler frames 62 moved in unison, the controller 70 would actuate the linkage mechanism 60 to correct the lateral sheet position.

Additionally, by measuring the sheet lateral position at the sensors 22, 24 and knowing the spacing of the sensors 22, 24, skew of the sheet 5 relative to the nip assemblies 30 can be calculated, as is known in the art. Alternatively, a similar skew orientation of the sheet 5 can be detected by other sensor systems, disposed upstream of the nips 30. For example, a pair of point sensors or one or more array sensors capable of measuring sheet position and/or skew can alternatively be provided.

A controller 70 is used to receive sheet information from edge sensors 22, 24 and any other available input that can provide useful information regarding the sheet(s) 5 being handled in the system. The controller 70 can include one or more processing devices capable of individually or collectively receiving signals from input devices, outputting signals to control devices and processing those signals in accordance with a rules-based set of instructions. The controller 70 can then transmit signals to one or more actuation systems. For example a rack and gear assembly could be actuated by the controller 70 in order to shift the configuration of the idler frames 62 between that shown in FIGS. 5 and 6. Also, the controller 70 can activate a differential drive system for correcting skew or process speeds. Thus, based on the position/orientation of the sheet input into the controller 70, a "correction profile" is calculated to eliminate the detected positional and/or timing error(s).

Figure 8:
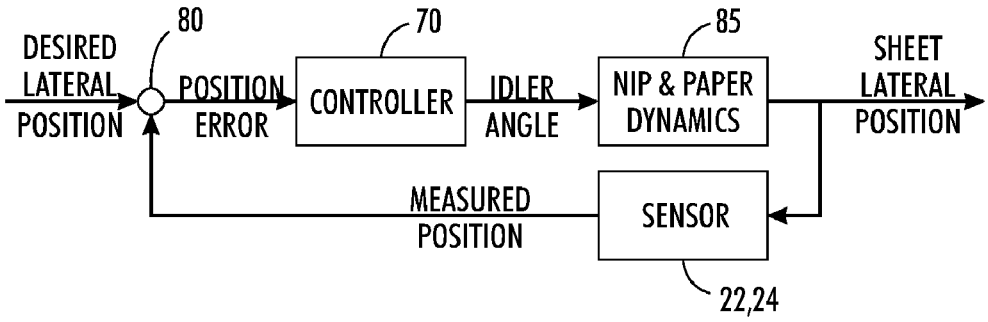
FIG. 8 is a schematic block diagram of a lateral registration control method in accordance with an aspect of the disclosed technologies.

FIG. 8 shows a schematic block diagram of a lateral registration control method used in accordance with an embodiment of the disclosed technologies. The registration method includes a predesignated or desired sheet position for proper registration within the system. Such positional information particularly includes lateral sheet position, but can additionally include sheet skew and process position/timing information. The method initiates at 80 when a lateral sheet position error is noted as compared to the predesignated lateral sheet position. The controller 70 is provided with a lateral sheet position measurement, such as from edge sensors 22, 24, which indicates the noted error. Additionally, the lateral edge sensors 22, 24 can provide controller 70 with skew and/or process position measurements. The controller 70 then acts to correct the measured lateral positioning error by transmitting a command to angle the idler rollers 51 relative to the driven wheels 41. Preferably, the idler rollers 51 can be angled in either lateral direction (inboard or outboard) relative to the process direction. Both of the idler rollers 51 can be pivoted by the same angle in unison through a linkage mechanism or independently pivoted the same amount. The angle $\alpha$ of the idler rollers is selected based on the amount of lateral movement needed to correct the sheet position. Alternatively, a predesignated idler roller angle $\alpha$ can be used, such as 10 degrees, with the duration of such angling varied to achieve the amount of desired lateral movement. As the idler rollers 51 achieve the desired angle the nips 30 will induce lateral movement through a nip and paper dynamics 85 in accordance with an aspect of the disclosed technologies.

As yet a further alternative, independently pivoting idler rollers 51 can be angled differently in order to also induce or remove/prevent buckling of the sheet 5. If the idler velocity vectors 12 of the two idler rollers 51 are angled slightly away from one another, it will remove/prevent buckling, whereas if they are angled toward one another it will induce buckling or relieve lateral tension on the sheet.

While the sheet 5 is still engaged by the nips 30 and at least one sensor 22, 24 is still able to register a lateral position for the sheet, such sheet position information can be further correlated to the predesignated lateral position. By continually monitoring sheet position using the sensors 22, 24 a closed-loop feedback regarding positional errors can be provided to the controller 70. The controller 70 can thus continue to make adjustments to the idler angle(s) as needed. Further, by providing additional downstream sensors (not shown) measuring lateral and/or skew position, the closed-loop feedback can be provided to controller 70 over a greater length of the sheet in order to make continuous adjustments to the skew and/or lateral position while the sheet remains engaged by the nips 30. Once the sheet is no longer engaged by the nips 30, the idler angle(s) can be returned to zero or another default angle value for the next approaching sheet.

In addition to lateral position correction, other registration correction systems such as a differential drive system can be used to perform skew and/or process timing corrections. It should be understood that such skew, process and lateral adjustments can occur in any order or can occur at or near the same time. During any adjustment of skew, cross-process or process positioning or timing, any downstream nips are preferably opened to allow the sheet 5 to be adjusted more freely.

Often media handling assembly, and particularly printing systems, include more than one module or station. Accordingly, more than one registration system 100 as disclosed herein can be included in an overall media handling assembly.

Further, it should be understood that in a modular system or a system that includes more than one registration system 100, in accordance with the disclosed technologies herein, could detect sheet position and relay that information to a central processor for controlling registration, including lateral position and skew in the overall media handling assembly. Thus, if the sheet positional errors are too large for registration system 100 to correct, then correction can be achieved with the use one or more subsequent downstream registration systems 100, for example in another module or station.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. An apparatus for laterally registering a sheet moved in a process direction along a transport path in a media handling assembly, a lateral direction extending perpendicular to the process direction, the assembly comprising:

at least two nip assemblies spaced apart from one another along a first axis extending in the lateral direction, each nip assembly including a driven wheel coupled to a drive mechanism regulated by a first controller, the driven wheel rotatably supported about the first axis, and an idler roller cooperating with the driven wheel to engage the sheet there between, the driven wheel imparting motion along the process direction to the sheet, the idler roller rotatably supported to freely rotate about a second axis, the second axis being selectively moveable relative to the first axis, the selective movement being between a first and second orientation while the sheet is moved along the transport path by the driven wheel with the cooperation of the idler roller, wherein in the first orientation the second axis extends parallel to the first axis, wherein in the second orientation the second axis extends at an oblique angle to the first axis, the selective movement pivoting about a third axis substantially extending through a centerline common to both the driven wheel and the idler roller of each nip assembly, wherein the selective movement of at least one of the at least two nip assemblies is independent from the selective movement of another of the at least two nip assemblies.

2. The apparatus of claim 1, wherein the selective movement of the at least two nip assemblies occurs in unison.

3. The apparatus of claim 1, wherein in the second orientation the oblique angle does not exceed a predesignated limit value.

4. The apparatus of claim 1, wherein at least one of the at least two nip assemblies is disposed in the first orientation while another of at least two nip assemblies is disposed in the second orientation.

5. The apparatus of claim 1, further comprising:

a second controller for actuating the idler roller to move between the first orientation and the second orientation.

6. The apparatus of claim 1, further comprising:

at least one sensor for detecting a lateral position of the sheet.

7. The apparatus of claim 1, wherein a first surface material of the driven wheel is more compliant than a second surface material of the idler roll.

8. A method of registering a lateral position of a sheet moved substantially in a process direction along a transport path in a media handling assembly, a lateral direction extending perpendicular to the process direction, the method comprising:

providing at least two nip assemblies, each nip assembly including a driven wheel and an idler roller, the driven wheel being coupled to a drive mechanism regulated by a controller and being rotatably supported about a first axis extending in the lateral direction, the idler roller cooperating with the driven wheel to engage the sheet there between, wherein the driven wheel imparts motion along the process direction to the sheet, the idler roller rotatably supported to freely rotate about a second axis; and inducing relative pivotal movement between the driven wheel and the idler roller about a third axis substantially extending through a centerline common to both the driven wheel and the idler roller, whereby the induced pivotal movement pivots the second axis of rotation between a first and second orientation while the sheet is moved along the transport path by the driven wheel with the cooperation of the idler roller, wherein in one of the first and second orientations the second axis extends parallel to the first axis and in the other of the first and second orientations the second axis extends oblique to the first axis, wherein induced pivotal movement of at least one of the at least two nip assemblies is independent from the induced pivotal movement of another of the at least two nip assemblies.

9. The method of claim 8, further comprising:

measuring a lateral position of the sheet at least one of during and after the induced pivotal movement for continuous relative pivotal adjustment between the driven wheel and the idler roller.

10. The method of claim 8, wherein the at least two nip assemblies are spaced apart from one another along the first axis.

11. The method of claim 10, wherein the induced pivotal movement of the at least two nip assemblies occurs in unison.

12. The method of claim 8, wherein the induced pivotal movement of each of the at least two nip assemblies pivots a different degree of rotation from the other of the at least two nip assemblies.

13. The method of claim 8, wherein one of the driven wheel and idler roller having a less compliant outer surface is induced with the pivotal movement.

14. The method of claim 13, wherein the idler roller is the one having the less compliant outer surface.

* * * * *